United States Patent [19]

Peroutky

[11] 4,260,269

[45] Apr. 7, 1981

[54] SPLIT STACKABLE PRINTING BLADES FOR MATRIX PRINTER HEAD

[75] Inventor: Donald C. Peroutky, Schenectady, N.Y.

[73] Assignee: General Electric Company, Schenectady, N.Y.

[21] Appl. No.: 51,727

[22] Filed: Jun. 25, 1979

[51] Int. Cl.[3] ..... B41J 3/10

[52] U.S. Cl. ..... 400/121; 29/602 R

[58] Field of Search ..... 400/124, 121; 29/602

[56] References Cited

U.S. PATENT DOCUMENTS

| | | | |
|---|---|---|---|
| 2,650,316 | 8/1953 | Johns et al. | 29/602 |
| 2,878,855 | 3/1959 | Gakle et al. | 29/602 |
| 3,129,495 | 4/1964 | Kohlhagen | 29/602 |
| 3,447,455 | 6/1969 | Shneider | 101/93.48 |
| 3,459,976 | 8/1969 | Nyman | 310/36 |
| 3,483,966 | 12/1969 | Dagneli et al. | 29/602 |
| 3,624,896 | 12/1971 | Daubeney et al. | 29/602 |
| 3,742,800 | 7/1973 | Frohrib | 83/587 |
| 3,952,153 | 4/1976 | Nijenhuis et al. | 101/93.04 |
| 3,964,384 | 6/1976 | Johnston | 101/93.48 |
| 3,968,744 | 7/1976 | Kasu et al. | 101/93.02 |
| 3,971,311 | 7/1976 | Deproux | 400/124 |
| 4,014,258 | 3/1977 | Wassermann | 101/93.29 |
| 4,044,455 | 8/1977 | Watanabe et al. | 101/93.29 |
| 4,109,776 | 8/1978 | Ek et al. | 400/124 |
| 4,129,390 | 12/1978 | Bigelow et al. | 400/121 |

*Primary Examiner*—William Pieprz

*Attorney, Agent, or Firm*—Geoffrey H. Krauss; James C. Davis; Marvin Snyder

[57] ABSTRACT

Flat, stackable printing blades for use in an impact printer head of the dot-matrix type, each blade including a conductive coil fastened within a central aperture of a conductive frame having a pair of arms resiliently connecting the coil frame to a stationary mounting portion. The mounting portion and the coil-retaining frame are split, with one of a pair of coil leads attached to each of the pair of electrically-isolated blade members thus formed, for facilitating a flow of current from one portion of the mounting tab, through one resilient arm and the coil, and thence through the remaining resilient arm to the remaining portion of the mounting tab. A stack of blades, having printing tips extending from the frame in a common direction, is arrayed to form a dot-matrix-type printhead.

12 Claims, 6 Drawing Figures

Fig. 2
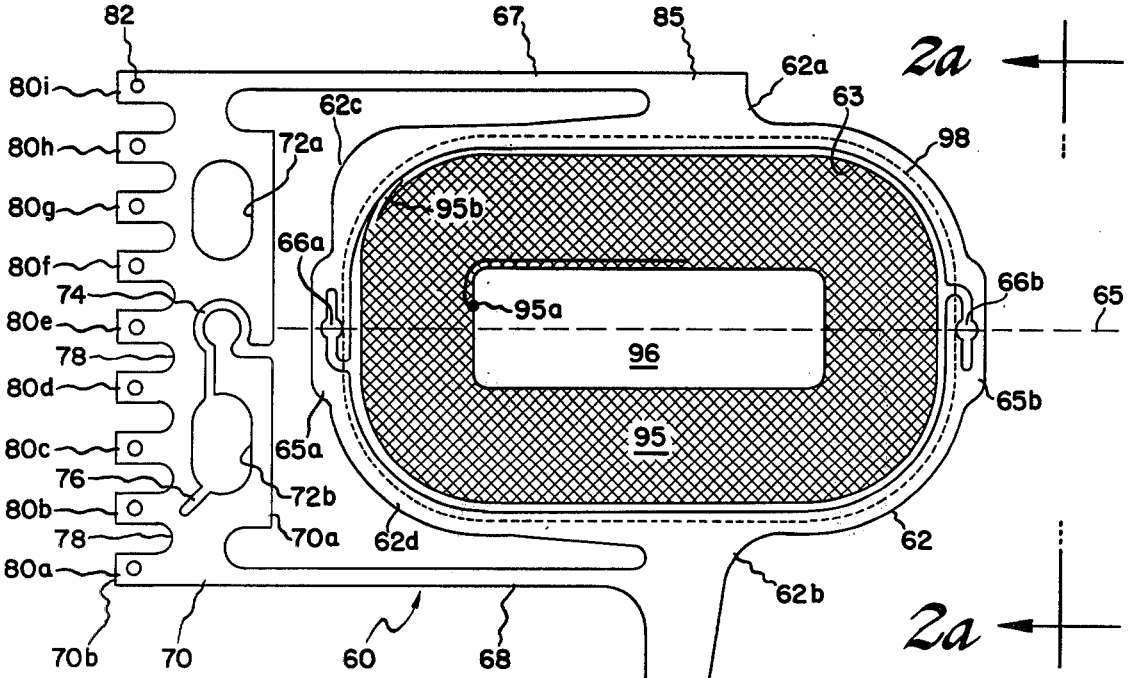
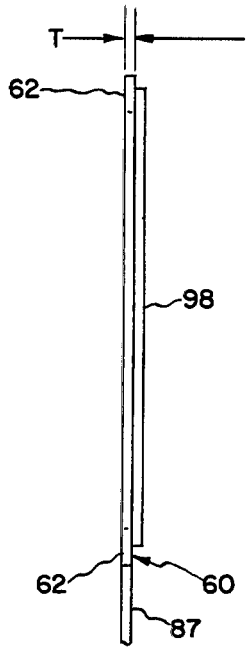
Fig. 2a

SPLIT STACKABLE PRINTING BLADES FOR MATRIX PRINTER HEAD

BACKGROUND OF THE INVENTION

The present invention relates to information printers of the dot-matrix type and, more particularly, to novel split-frame stackable blades for use in the printhead thereof.

Known embodiments of printer blades for use in dot-matrix printers may be as described and claimed in U.S. Pat. No. 4,129,390, issued Dec. 12, 1978 to the assignee of the present invention and incorporated herein by reference. The printer blades described therein have a mount portion attached to an oval-shaped rim by a pair of resilient arms; a coil of conductive ribbon is wound about a substantially oval central member and is insulatively maintained within the oval rim. A printing tip, extending away from the coil-bearing rim, is caused to move and to impact an ink-retaining ribbon and ink-retaining media, when current flowing through the coil interacts with a transverse magnetic field. The interaction moves the integral combination of coil-rim-printing tip and results in deflection of the resilient arms with respect to the stationary mounting portion. This configuration, while having many desirable features, does experience connection failure at (a) the connective lead attachment at the inner, coil-bearing rim, at which point one end of the coil is attached, and (b) the coil connection to the outer rim, which is itself integrally joined to the resilient arms-mounting portion of the blade. A more reliable printing blade for use in a matrix-type printer head, is desirable.

BRIEF SUMMARY OF THE INVENTION

In accordance with the invention, a printhead for a dot-matrix printer comprises a plurality of stacked printing blades. Each blade has a stationary mounting portion attached to a common housing member of the printhead and also has a printing tip. The printing tips of all of the plurality of blades are arranged along a common line extending outwardly from the printhead for selectively and individually impacting a printing medium. Each print blade is formed of a single piece of resilient, conductive material and has a generally oval-shaped rim portion spaced from the mounting portion and supported by a pair of generally parallel resilient arms integrally joined between opposite locations on the rim and on the opposite ends of the mounting tab. A coil wound of flat conductor is positioned within the central opening of the rim; the outer end of the coil is joined to a first portion of the rim, to one side of an imaginary line passing through the center of rim and parallel to the arms, while a thin piece of conductive foil insulatively overlies the coil to connect the inner end of the coil to a second portion of the rim lying on the opposite side of the line. The coil is cemented in place within the rim and a thin insulating film is cemented across one surface of the coil-rim combination. Opposite sections of the rim, along the imaginary line, and the mounting portion are then split, to provide a pair of conductive blade portions, each acting as a conductive member connecting one end of the coil through an associated resilient arm to an associated part of the split mounting portion.

In one preferred embodiment, the plurality of blades are stacked in side-by-side relationship, with insulative material placed between each pair of aligned mounting portions. Insulated members are utilized to fix the mounting portions to a frame member of the printing head. A common aligned tab on one part of each mounting portion provides for a first connection to each of the coils, while a set of indexed tabs positioned at a different point upon the remaining part of each mounting portion of each of the plurality of blades, provides separate connection points for the remaining end of the coil of each of the plurality of printing blades. A flow of current through the coil of a particular blade interacts with a magnetic field formed transverse to the coil plane of all of the stacked blades, to cause movement of the printing tip of the energized blade in a direction substantially parallel to the mounting portion, for impacting upon reception media for subsequent formation of characters, symbols and other indicia in dot-matrix fashion.

Accordingly, it is an object of the present invention to provide novel split printing blades and methods of fabrication therefor, for use in a matrix printer head, wherein the printing blades provide highly reliable electrical connections to the coils of the blades.

This and other objects of the present invention will become apparent to those skilled in the art upon consideration of the following detailed description, taken in conjunction with the drawings.

BRIEF DESCRIPTION OF THE DRAWINGS

FIG. 2 is a plan view of a unitary printing blade member; and

DETAILED DESCRIPTION OF THE INVENTION

Figure 1A:
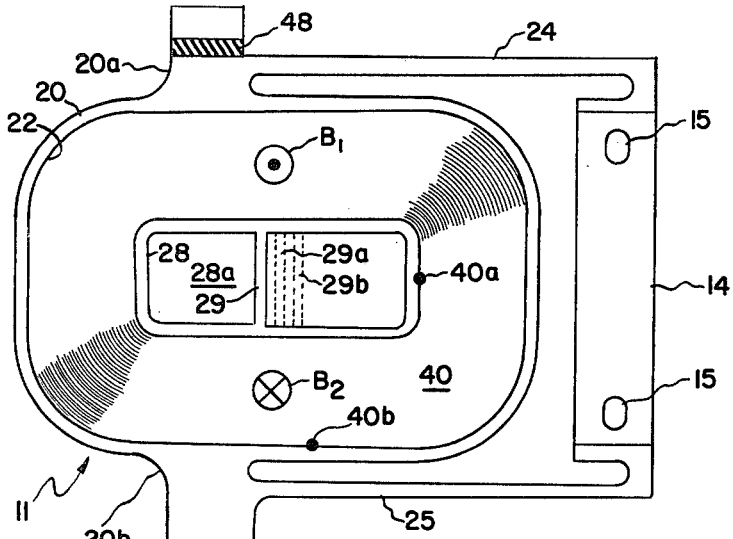
Fig. 1a (PRIOR ART)
FIG. 1*a* is a plan view of a prior art printer blade.
Figure 1B:
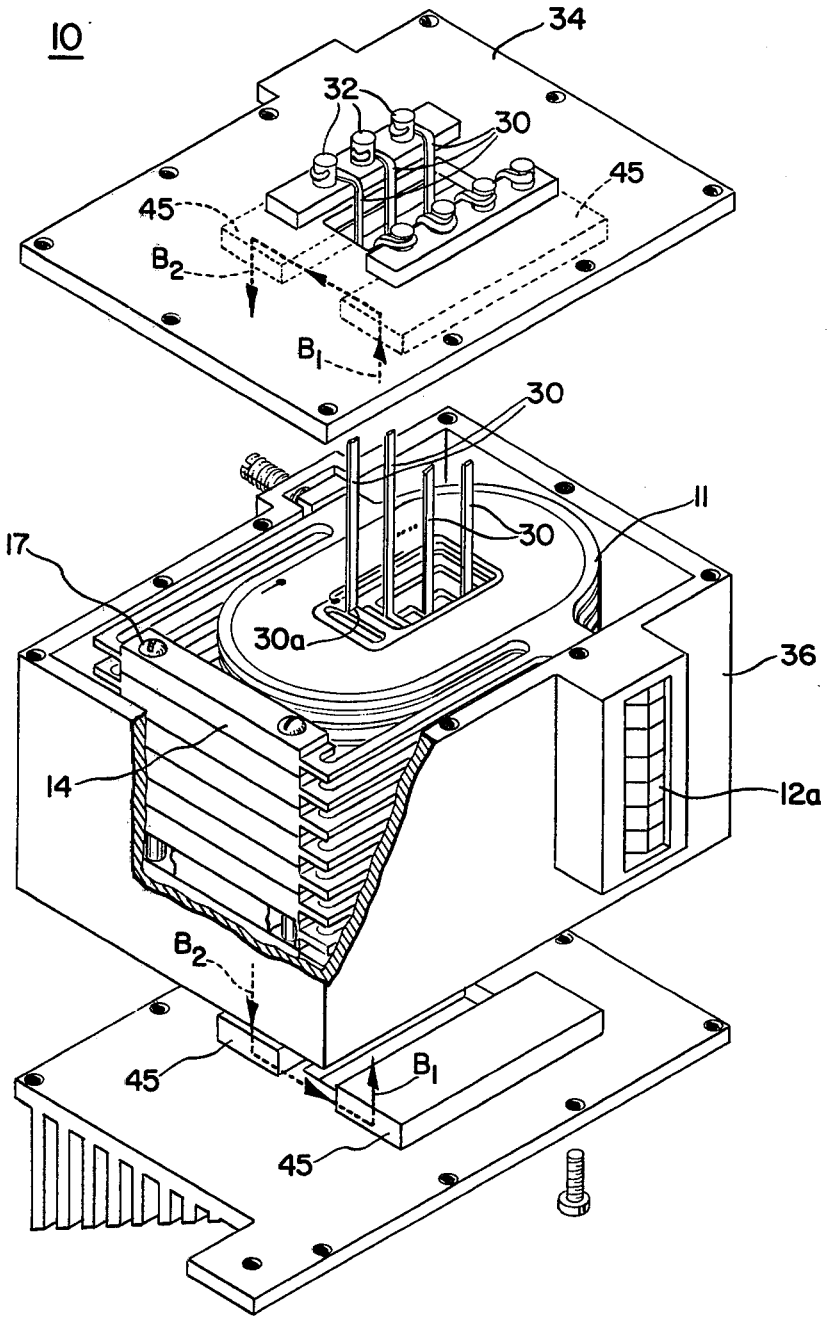
Fig. 1b (PRIOR ART)
FIG. 1*b* is a prospective view of a prior art printer head, utilizing the printing blades of FIG. 1*a;*

Referring initially to FIGS. 1*a* and 1*b*, a prior art printhead 10, as described and claimed in the above-mentioned U.S. Pat. No. 4,129,390, utilizes a plurality, illustratively seven in number, of printing blades 11. Each printing blade includes a printing tip 12 having translational motion when the printing tip is caused to move with respect to a mounting portion 14. The mounting portion 14 is relatively thick and has a plurality of apertures 15 each receiving a fixed pin 17 therethrough to facilitate stacking a plurality of blades 11 with their thickened mounting portions 14 in abutment with each other.

Each printing blade is formed of a unitary frame including a central oval-shaped rim 20, of relatively lesser thickness than mount portion 14, and having an aperture 22 formed therethrough of similar oval-shaped, but of slightly smaller, dimensions in the non-magnetic, conductive blade member frame. A pair of substantially linearly elongated and substantially parallel resilient spring arms 24 and 25 respectively, couple opposite ends of mount portion 14 to one of outward extensions 20*a* and 20*b* formed on rim 20. Outward extension 20*b* is further extended to form a beam 26, below resilient arm 25, to position printing tip 12 at a selected distance therefrom. The printing tip is intentionally thickened to the same thickness as that of mount portion 14 to provide a substantially square printing surface 12*a*.

A hub member 28 has an oval shape and has a central oval aperture 28*a* bridged by a thin tab 29 at one of a plurality of positions, shown in broken line by alternate tab positions 29*a*, 29*b*, etc. Non-interfering connection to each of the plurality of stacked blades is provided means of flexible leads 30, with each lead having a first end 30*a* connected, as by welding and the like processes, to one of tabs 29. Each lead 30 has a remaining end coupled to an insulated terminal 32 upon a cover 34 of the printhead housing 36. A single-layer coil 40, of wire with substantially rectangular cross-section, is wound about the periphery of central hub 28. A first end 40*a* of the coil is joined to the hub and the remaining coil end 40*b* is joined to rim 20. Thus, current may flow from a source (not shown) connected to one of terminals 32, through the associated flexible lead 30, to hub 28 and thence into coil 40 at first end 40*a*. The coil current exits at coil end 40*b* and flows through rim 20 and resilient arms 25 to mounting portion 14, forming a common connection for all stacked printing blades in a print head. The flow of currents through the coil interacts with magnetic field $B_1$ and $B_2$, flowing in opposite directions through opposite portions of the coil, as provided by a set of magnets 45 external to the stack of printer blades, but within printhead 10. Thus, when current flows through coil 40, force is generated within the coil, causing the printing tip to move outward from housing 36, to impact printing media; upon cessation of coil flow, the energy stored in resilient arms 24 and 25 returns the printing blade to its original position. A stop member 48 is utilized to absorb the return energy of the printing blade and position the blade for the next current-pulse-altered printing movement.

The connection, at point 30*a*, of one end of each lead 30 to the associated cross-tab 29, is prone to breakage, and renders the printhead unusable until delicate and time-consuming repair has been made. It is thus desirable to provide printing blades having improved coil connection means for use in a dot-matrix printer head of this type.

Referring now to FIGS. 2 and 2*a*, an improved printing blade 60 is fabricated by chemically etching a single sheet of a non-magnetic conductive material, such as beryllium copper and the like, to include a generally oval-shaped rim 62 having a generally oval-shaped aperture 63 formed centrally therein and having a pair of outward extensions 62*a* and 62*b* formed outwardly upon the respective parallel longer sides of rim 62. A pair of formation 65*a* and 65*b* are formed substantially opposite each other, along an imaginary line 65 cutting through aperture 63 and the shorter sides of oval-rim 62; each formation includes a slot 66*a* and 66*b*, respectively, cutting partially, but not completely, through the thickness of rim 62. A pair of linearly elongated and substantially parallel resilient spring arms 67 and 68, respectively, extend substantially parallel to the longer sides of oval rim 62, respectively from rim extensions 62*a* and 62*b*. A mounting member 70 is formed substantially transverse to, and between, the ends of resilient arms 67 and 68 furthest from rim extension 62*a* and 62*b*. Mounting member 70 is somewhat rectangular in shape and includes a pair of apertures 72*a* and 72*b*, for passing insulated-shank fastening means, to facilitate mounting a stack of a plurality of printing blades in a printer head housing, as more fully explained hereinbelow. A channel 74 is formed, during initial etching of the printer blade blank, to connect the interior mounting member edge 70*a* to the open area of one of the fastening means apertures, e.g. aperture 72*b*. An additional channel portion 76 may advantageously be formed from the open aperture interior of the same aperture (aperture 72*b*) and extends partially, but not completely, through the remaining width of mounting member 70 toward the remaining, outward edge 70*b* thereof. A plurality of indentations 78 are formed into outer mounting member edge 70*b* to define a series of substantially equally spaced tabs 80*a*–80*i*, each having a small aperture 82 formed therein for receiving a current-carrying lead (not shown). The number of formations 80 is equal to one more than the number N of blades to be utilized in a given printer head configuration. Advantageously, channel portion 76 is so positioned as to extend from one of the fastening means apertures (e.g. aperture 72*b*) toward the indentation 78 between the first and second tabs 80*a* and 80*b* for a purpose hereinbelow explained.

Figure 3A:
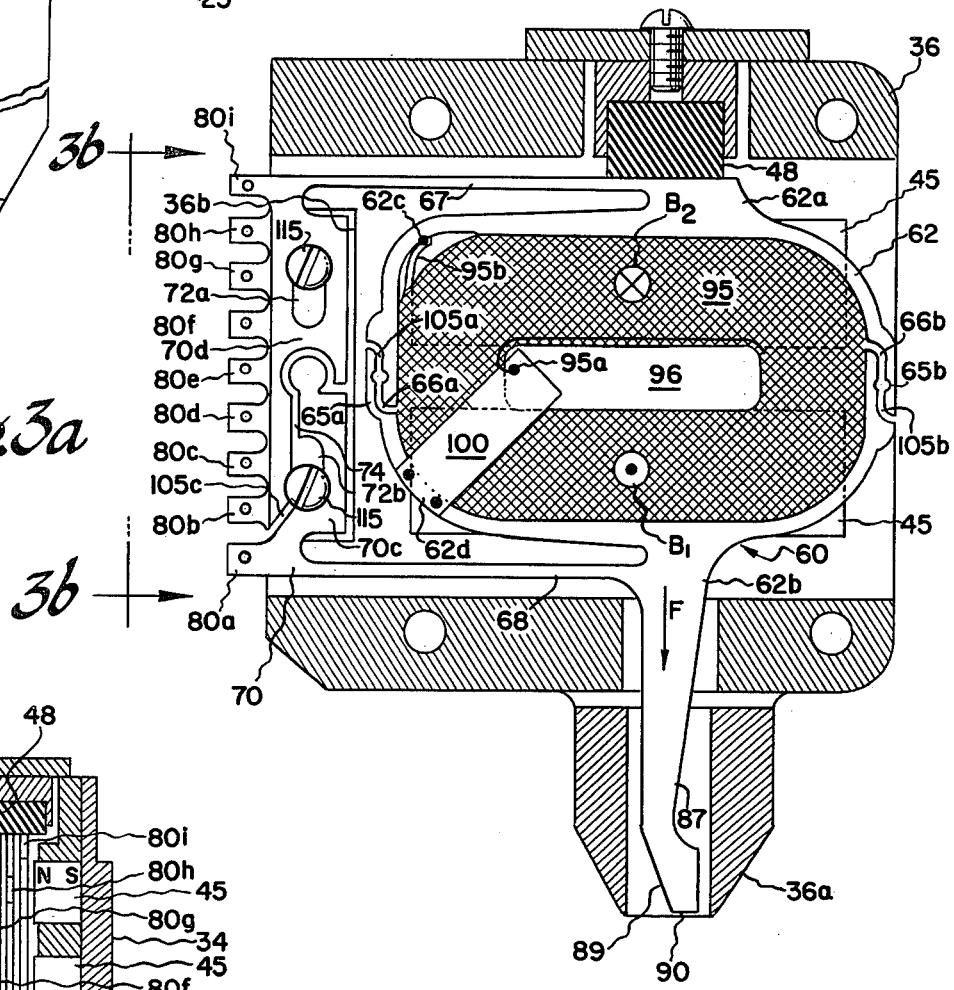
FIGS. 3*a* and 3*b* are respectively a plan view and an end view of a printhead utilizing a plurality of printing blades fabricated from the printing blade member of FIG. 2, in accordance with the principles of the present invention.
Figure 3B:
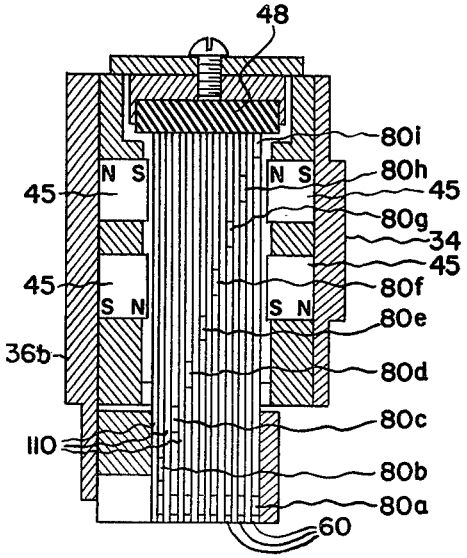

One of outward rim extensions 62*a* and 62*b*, e.g. extension 62*a*, is provided with a flat portion 85, against which the stop member 48 (FIGS. 3*a* and 3*b*) may bear, while the other outward extension, e.g. extention 62*b*, continues outwardly of rim 62 to form a beam 87 carrying a printing tip 89 at the end thereof furthest from the rim. Printing tip 89 has a flat surface 90 for impacting against printing media, such as an ink ribbon and paper sheet (both not shown for reasons of simplicity).

After printing blade blank 60 is etched to a shape in accordance with the above description, a flat coil 95 of conductive wire, wound to have a central aperture 96*a* and having the turns thereof insulated from each other, is positioned within aperture 63 formed in oval rim 62. Coil 95 is so formed that a first end 95*a* thereof is positioned along the periphery of interior coil aperture 96, substantially at one of the ends thereof having a smaller dimension. The remaining coil end 95*b* is positioned at the exterior periphery of coil 95. Advantageously, a portion 62*c* of the oval rim is slightly distorted outwardly, from an oval shape, to provide an area, adjacent to the location at which exterior coil lead 95*b* will be placed when the coil is positioned within blade aperture 63, to facilitate attachment of outer coil lead end 95*b* to rim portion 62*c*, as by welding, soldering and the like processes. Coil 95 is of thickness substantially equal to the thickness T (see FIG. 2*a*) of the blade member frame 60 and, when coil 95 is positioned within aperture 63 and cemented therein, the coil-bearing blade member has substantially the blade thickness T. A thin insulating film 98 is fastened in place across one surface of the coil 95 and blade rim 62 to provide insulation between adjacent printing blades in a stack of a plurality of such blades. The area of film 98 is of substantially oval shape, and of greater extent than the oval-shaped coil 95, but of slightly lesser extent than the outer periphery of rim 62 (see film 98 shown in broken line in FIG. 2).

After cementing coil 95 in place and applying insulating film 98, a thin conductive foil strip 100 (FIG. 3*a*) is positioned between that end of coil aperture 96 at which coil end 95*a* is located and a portion 62*d* of the rim located upon the opposite side of imaginary line 65 from rim portion 62*c* at which the exterior coil lead 95*b* is connected. One end of foil strip 100 is electrically connected, as by welding, soldering and the like, at rim portion 62*d*, while the remaining end of foil strip 100 is electrically connected to interior coil lead 95*a*. Thus, the opposite ends of coil 95 are respectively in electrical connection to rim portions 62*d* and 62*c*, respectively.

Advantageously, foil strip 100 is also cemented to coil 95 for greater mechanical stability.

After the cement, utilized to hold coil 95 within aperture 63 and then hold film 98 to the surface of blank 60, has hardened to rigidly hold the blade rim and coil in planar relationship, the blade rim and mounting portions are split by the formation of additional channels 105*a* and 105*b* respectively in rim portions 65*a* and 65*b*, and by channel 105*c* in mounting member 70. Thus, rim channels 66*a* and 66*b* are extended completely through the rim portion by respective channels 105*a* and 105*b*, and mounting member 70 is split into a first mounting part 70*c*, having tab 80*a* thereon, and a second mounting part 70*d*, having the remaining mounting tabs 80*b*–80*i* thereon, by channel 105*c* continuing the break formed by channels 74 and 76 and by aperture 72*b*. All but one of the remaining N tabs 80*b*–80*i* on mounting part 70*d* are now removed; the particular tab remaining is associated with the position of a printer blade in a stack of a plurality thereof. Thus, in FIG. 3*b*, the eight stacked blades shown have, from left to right as illustrated, sequentially staggered tab positions 80*b*, 80*c*, 80*d*, 80*e*, 80*f*, 80*g*, 80*h* and 80*i* provided at the end of the sequentially arranged blades, whereby connection can be made in non-interfering and unique manner.

It will be seen that current (from a current driving source not shown) will flow into a particular blade at one of the blade-position-associated tabs 80*b*–80*i* thereof, and will flow through mounting part 70*d*, upper resilient arm 67 and rim portion 62*c* to outer coil end 95*b*. The current flows through coil 95 and exits therefrom at interior coil end 95*a*, flowing through foil strip 100 to rim portion 62*d*, thence through lower resilient arm 68 to mounting part 70*c* and common contact tab 80*a*.

The current thus flowing in coil 95 interacts with magnetic fields $B_1$ and $B_2$ provided by magnets 45, to generate a force F causing extension of printing tip 89 beyond the face of printing tip housing portion 36*a*, while temporarily twisting arms 67 and 68 to store force therein. Upon cessation of the current, the force stored in resilient arm 67 and 68 acts to return the blade towards its rest position, and against stop 48.

The hollow rectangular housing 36 has a shelf-like formation 36*b* at one end of the central cavity thereof, for receiving the two parts of the mounting portion of each blade in a stack of a plurality of aligned blades. A thin sheet 110 of insulated material is placed between the aligned mounting portions 70 of each pair of adjacent blades in the stack and between the mounting portion 70 of bottom-most blade in the stack and the housing shelf-like formation 36*b* on which the stack mounts. Each sheet 110 has apertures formed therethrough in alignment with the apertures 72*a* and 72*b* in the aligned mounting portions. Fastening means, such as screws 115, having insulated shanks, are passed through the aligned mounting apertures 72*a* and 72*b* of the stack of blades and fastened into printer head housing shelf 36*b* to fasten the blade stack within the housing. Additional details concerning the housing and printer head may be found in the above-incorporated U.S. Pat. No. 4,129,390.

One presently preferred embodiment of my novel improved printer blade, having split rim and mounting member, has been described herein. Many variations and modifications, in accordance with the principles of the present invention, will now occur to those skilled in the art. It is my intent, therefore, to be limited only by the scope of the appending claims and not by the specific detail shown herein.

What is claimed is:

1. In a printing blade of the type having an oval conductive rim with an oval aperture therein in which a flat-wound coil is retained, said blade having a printing tip extending outwardly from one side of said rim, and a mounting portion spaced from said rim and substantially parallel to said printing tip extension, and a pair of substantially parallel resilient elongated arms each extending from an opposite end of said mounting portion to associated opposite points on said rim, the improvement comprising:

said rim having a pair of formations lying generally along an imaginary line passing through said oval rim aperture and substantially parallel to the direction of elongation of said resilient arms, said formations being cut completely though said rim to form said rim into first and second portions electrically isolated from one another and each integrally joined to one of said resilient arms;

said coil being rigidly fastened within said aperture and having an outer end electrically connected to one of said first and second portions and having an inner end, a central aperture of said coil being completely devoid of any conductive or supportive member therein;

means for connecting the inner end of said coil to the remaining one of said first and second rim portions;

said mounting portion being split into first and second coplanar parts each integrally joined and electrically connected to an associated one of said resilient arms; and means formed on said first and second parts of said mounting portion for facilitating a flow of electrical current, introduced into one mounting portion part, through a first one of said resilient arms into a first end of said coil and from the remaining end of said coil through the remaining resilient arm to the remaining one of said first and second mounting portion parts.

2. The improved printing blade of claim 1, further comprising a member of insulating material covering one side of said rim and the coil rigidly mounted therein.

3. The improved printing blade of claim 2, wherein at least one of said first and second mounting portion parts has a formation therein for facilitating mounting of said printing blade.

4. The improvement in blade of claim 3, wherein said mounting formation comprise an aperture formed in at least one of said first and second mounting portions.

5. An improved printhead comprising a plurality of the printing blades of claim 1, said printing blades being arranged in a stack with the mounting portions and printing tips of said plurality of blades being in alignment; a printer housing having a formation adapted to receive the stacked mounting portions of said plurality of blades; a plurality of members of insulative material, one of said insulative material members being positioned between each pair of adjacent blade member mounting portions and also between the printer housing mounting formation and an adjacent mounting portion of the nearest blade of said stack thereof; and insulative means for fastening said aligned stack of mounting portions to said printer housing mounting formation.

6. The improved printer head of claim 5, wherein said current flow facilitating means comprises a tab formed upon each of the first and second mounting portion of each of said plurality of stacked blades; said tabs formed upon one of said first and second mounting portion parts being in a like position on all blades of said stack and the tab formed upon the remaining mounting portion part being in a sequentially differing position for each blade within the stack.

7. A method for fabricating a printing blade for use in a matrix printhead, comprising the steps of:

providing a blank of a non-magnetic, conductive material;

removing portions of said blank to fabricate a printing blade frame having an elongated oval rim with an aperture therein, an extension from a first one of the longer sides of said rim forming an elongated beam carrying a printing tip, a mounting portion spaced from said rim and substantially parallel to said beam, and a pair of elongated resilient arms each integrally joined to an opposite end of said mounting portion and substantially to opposite points on said rim along a line formed by the extension of said beam through said rim;

forming, along an imaginary line cutting through said rim aperture and substantially parallel to the direction of elongation of said arms, channels breaking said rim into first and second electrically insulated portions;

rigidly fastening within said rim aperture a coil having outer and inner ends and a central aperture completely devoid of any conductive or supportive member therein;

connecting the outer end of said coil to one of said first and second rim portions;

connecting the inner end of said coil to the remaining one of said first and second rim portions;

breaking said mounting portion of said blade into first and second coplanar parts each insulated from one another and integrally joined to one of said resilient arms; and providing means formed on each of said first and second parts of said mounting portion for facilitating introduction of current flow from one part of said mounting portion through an associated resilient arm to one end of said coil and then through said coil to the other end thereof and through the associated rim portion and resilient arm to the remaining part of the mounting portion.

8. The method of claim 7, wherein the channel forming step comprises the steps of forming channels partly through said rim at each of a pair of positions along said imaginary line and at opposite sides of said rim; and, after said coil is fastened within said rim, extending said channels completely through said rim to separate said rim at the location of each channel.

9. The method of claim 7, further comprising the step of fastening a member of insulating material to cover one side of said rim and the coil rigidly fastened therein.

10. The improved printing blade of claim 1, wherein said connecting means comprises a flexible conductive member overlying a portion of said coil and connecting the inner end of said coil to the remaining one of said first and second rim portions.

11. In a printing blade of the type having an elongated conductive rim with an aperture therein in which a flat-wound coil is retained, said blade having a printing tip extending outwardly from one of the longer sides of said rim, and a mounting portions spaced from said rim and substantially parallel of said printing tip extension, and a pair of substantially parallel resilient elongated arms each extending from an opposite end of said mounting portion to an associated opposite point of said rim, the improvement comprising:

said rim having a pair of formations lying on the shorter sides of said rim aperture and substantially parallel to the direction of elongation of said resilient arms, said formations being separable through said rims to form said rim into said first and second portions electrically isolated from one another and each integrally joined to one of said resilient arms;

said mounting portion having a formation formed therein, said mounting portion formation being separable to form said mounting portion into first and second coplanar parts electrically isolated from one another and each integrally joined to one of said resilient arms;

said coil being fastened within said aperture and having an outer end electrically connected to said one of said first and second portions and having an inner end, a central aperture of said coil being completely devoid of any conductive or supportive member therein;

means for connecting the inner end of said coil to the remaining one of said first and second rim portions; and means formed on said first and second parts of said mounting portion for facilitating a flow of electrical current, introduced into one mounting portion part, through a first one of said resilient arms into a first end of said coil and from the remaining end of said coil through the remaining resilient arm to the remaining one of said first and second mounting portion parts.

12. A method for fabricating a printing blade for use in a matrix printhead, comprising the steps of:

providing a blank of a non-magnetic, conductive material;

removing portions of said blank to fabricate a printing blade frame comprising an elongated rim with an aperture therein, an extension from a first one of the longer sides of said rim forming an elongated beam carrying a printing tip, a mounting portion spaced from said rim and substantially parallel to said beam, and a pair of elongated resilient arms each integrally joined to an opposite end of said mounting portion and substantially to opposite on said rim along the line formed by the extension of said beam through said rim;

forming in the shorter sides of said rim aperture and in said mounting portion separable channels for separating said rim and said mounting portion into respective first and second electrically insulated portions;

fastening within said rim aperture a coil having outer and inner ends and a central aperture completely devoid of any conductive or supportive member therein;

connecting the outer end of said coil to one of said first and second rim portions;

connecting the inner end of said coil to the remaining one of said first and second rim portions;

separating said mounting portion of said blade at its separable channel into first and second coplanar parts each insulated from one another and integrally joined to one of said resilient arms and said rim at its separable channels into first and second parts each insulated from one another and integrally joined a respective one of said first and second parts of said mounting channel; and providing means formed at each of said first and second parts of said mounting portion for facilitating introduction of current flow from one part of said mounting portion through an associated resilient arm to one end of said coil and then through said coil to the other end thereof and through the associated rim portion and resilient arm to the remaining part of the remaining portion.

* * * * *